US011587724B2

(12) United States Patent
Igarashi et al.

(10) Patent No.: US 11,587,724 B2
(45) Date of Patent: Feb. 21, 2023

(54) WINDING-TYPE COIL COMPONENT AND DIRECT-CURRENT SUPERIMPOSING CIRCUIT USING THE SAME

(71) Applicant: Murata Manufacturing Co., Ltd., Kyoto-fu (JP)

(72) Inventors: Akio Igarashi, Nagaokakyo (JP); Yoshie Nakamura, Nagaokakyo (JP); Yasushi Saito, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 322 days.

(21) Appl. No.: 16/905,590

(22) Filed: Jun. 18, 2020

(65) Prior Publication Data

US 2020/0402706 A1 Dec. 24, 2020

(30) Foreign Application Priority Data

Jun. 24, 2019 (JP) ..... JP2019-116249
Feb. 3, 2020 (JP) ..... JP2020-016645

(51) Int. Cl.

| | |
|---|---|
| ***H01F 27/28*** | (2006.01) |
| ***H01F 27/29*** | (2006.01) |
| ***H01F 17/04*** | (2006.01) |
| *H01F 17/00* | (2006.01) |

(52) U.S. Cl.

CPC ..... *H01F 27/292* (2013.01); *H01F 17/045* (2013.01); *H01F 27/2804* (2013.01); *H01F 27/2828* (2013.01); *H01F 2017/0093* (2013.01)

(58) Field of Classification Search

CPC ..... H01F 17/045; H01F 2017/0093
See application file for complete search history.

(56) References Cited

U.S. PATENT DOCUMENTS

| | | | | |
|---|---|---|---|---|
| 2008/0036566 A1* | 2/2008 | Klesyk | H01F 27/027 29/605 |
| 2010/0045418 A1* | 2/2010 | Nishikawa | H01F 17/045 336/206 |
| 2015/0084731 A1* | 3/2015 | Takagi | H01F 19/08 336/212 |

(Continued)

FOREIGN PATENT DOCUMENTS

| | | | |
|---|---|---|---|
| JP | H08186034 | A | 7/1996 |
| JP | 2007036160 | A | 2/2007 |

(Continued)

*Primary Examiner* — Rina I Duda
(74) *Attorney, Agent, or Firm* — Studebaker & Brackett PC

(57) ABSTRACT

A direct-current superimposing circuit includes differential signal lines, capacitors, a common mode choke coil, a winding-type coil component, and a DC power supply which are disposed at a circuit board. The winding-type coil component includes a core, two pairs of terminal electrodes, and two windings (a first winding and a second winding). On the end surface of a flange portion, the terminal electrodes in one of the two pairs and the terminal electrodes in the other one of the two pairs are placed to face each other across the winding center of a winding core. The winding start and winding end of the first winding are connected to the terminal electrodes in one of the two pairs. The winding start and winding end of the second winding are connected to the terminal electrodes in the other one of the two pairs.

20 Claims, 6 Drawing Sheets

(56) References Cited

U.S. PATENT DOCUMENTS

| | | | | |
|---|---|---|---|---|
| 2016/0217919 | A1* | 7/2016 | Iwata | H01F 27/29 |
| 2017/0011844 | A1* | 1/2017 | Mikogami | H01F 41/127 |
| 2017/0256356 | A1* | 9/2017 | Takatsuji | H02M 3/156 |
| 2017/0288626 | A1* | 10/2017 | Kobayashi | H03H 1/00 |
| 2017/0345560 | A1* | 11/2017 | Tomonari | H03H 7/427 |
| 2018/0130597 | A1* | 5/2018 | Komaya | H01F 17/045 |

FOREIGN PATENT DOCUMENTS

| | | | |
|---|---|---|---|
| JP | 2007-103596 | A | 4/2007 |
| JP | 2007242843 | A | 9/2007 |
| JP | 2014207368 | A | 10/2014 |

* cited by examiner

WINDING-TYPE COIL COMPONENT AND DIRECT-CURRENT SUPERIMPOSING CIRCUIT USING THE SAME

CROSS-REFERENCE TO RELATED APPLICATIONS

This application claims benefit of priority to Japanese Patent Application No. 2019-116249, filed Jun. 24, 2019, and to Japanese Patent Application No. 2020-016645, filed Feb. 3, 2020, the entire contents of each are incorporated herein by reference.

BACKGROUND

Technical Field

The present disclosure relates to a winding-type coil component and a direct-current superimposing circuit using the same.

Background Art

There have been market demands for the superimposition of a direct current on a differential transmission signal line for the transmission of not only data but also power. To meet the demands, in particular, there are automotive communication standards such as Power over Data Lines (PoDL) and Automotive Audio Bus® (A2B). In a typical direct-current superimposing circuit compliant with this kind of communication standard, a direct-current (DC) power supply is connected to a differential transmission signal line for transmitting a differential signal transmitted/received by a differential communication integrated circuit (IC) via an inductor. The inductor is used for alternating-current (AC) cut and prevents an AC signal passing through the signal line from leaking into the DC power supply.

Examples of usage of such an inductor include the case where an independent coil with no magnetic coupling is used on each of the positive and negative sides of a DC power supply, and the case where a pair of coils with magnetic coupling is used. A coil component using the latter coil with magnetic coupling prevents a differential-mode signal from transmitting to a DC power supply using the high impedance thereof and allows common-mode noise to transmit to the DC power supply using the low impedance thereof.

Japanese Unexamined Patent Application Publication No. 8-186034 discloses a winding-type coil component as this kind of coil component.

This winding-type coil component includes a core, two wires (a first wire and a second wire), and two pairs of a first terminal electrode and a second terminal electrode. The core includes a winding core portion and a pair of flange portions formed at both ends of the winding core portion. The two wires, the first wire and the second wire, are wound around the winding core portion of the core in a pair. The first terminal electrode and the second terminal electrode in one of the two pairs are formed apart from each other on one side surface of one of the flange portions of the core, and the first terminal electrode and the second terminal electrode in the other one of the two pairs are formed apart from each other on the opposite side surface of the flange portion. Respective end portions of the first wire are electrically connected to the first terminal electrode and the second terminal electrode formed on the one side surface of the flange portion. Respective end portions of the second wire are electrically connected to the first terminal electrode and the second terminal electrode formed on the opposite side surface of the flange portion.

SUMMARY

However, it is known that, when the winding-type coil component disclosed in Japanese Unexamined Patent Application Publication No. 8-186034 is used in a direct-current superimposing circuit, a differential signal passing through a signal line is converted into common-mode noise and unnecessary noise is emitted.

The reason for this is that, in a winding-type coil component 1 illustrated in FIG. 1, which is disclosed in Japanese Unexamined Patent Application Publication No. 8-186034, including a core 2, two windings (a first winding 3 and a second winding 4), and two pairs (5*a* and 5*b*, 6*a* and 6*b*) of a first terminal electrode and a second terminal electrode, the number of turns of the first winding 3 represented by a solid line which is wound around a winding core 2*a* of the core 2 is larger than that of the second winding 4 represented by a dotted line by 0.5. That is, inductances formed by the two respective windings 3 and 4 become asymmetrical with each other and the degree of mode conversion in the winding-type coil component 1 becomes high. FIG. 1 is a bottom view of the winding-type coil component 1 as viewed from the end surface of a flange portion 2*b* of the core 2 brought into contact with the mounting surface of a circuit board.

In a direct-current superimposing circuit using the winding-type coil component 1 illustrated in FIG. 1, the routing of wiring patterns at a circuit board becomes complicated. For example, as illustrated in FIG. 2 illustrating the state of connection between the winding-type coil component 1 and each of differential signal lines 12*a* and 12*b*, the winding-type coil component 1 is placed between a pair of the differential signal lines 12*a* and 12*b* and a DC power supply 13. The wiring pattern forming the differential signal line 12*b* and the wiring pattern of a power line connecting the negative pole of the DC power supply 13 and a second terminal electrode 6*b* in the winding-type coil component 1 cross at positions A and B on both sides of a first terminal electrode 5*b* in the winding-type coil component 1. In FIG. 2, the same reference numerals are used to identify parts already described with reference to FIG. 1 or equivalent parts, and the description thereof will be omitted.

Accordingly, the present disclosure provides a winding-type coil component capable of preventing the occurrence of the above-described problem and suppressing the degradation in signal quality and a direct-current superimposing circuit using the winding-type coil component.

According to preferred embodiments of the present disclosure, there is provided a winding-type coil component including a core including a flange portion having an end surface brought into contact with a mounting surface of a circuit board and a winding core standing in a vertical direction with respect to the end surface, a pair of a first terminal electrode and a second terminal electrode that are placed to face each other across a winding core axis of the winding core on the end surface, and a pair of a third terminal electrode and a fourth terminal electrode that are placed to face each other across the winding core axis of the winding core on the end surface. The winding-type coil component further includes a first winding having one end portion, which is a winding start or a winding end, connected to the first terminal electrode and the other end portion, which is a winding start or a winding end, connected to the second terminal electrode, and a second winding having one end portion, which is a winding start or a winding end, connected to the third terminal electrode and the other end portion, which is a winding start or a winding end, connected to the fourth terminal electrode. The first winding and the second winding are wound around the winding core. The second terminal electrode to which the other end portion of the first winding is connected is connected to one of a pair of differential signal lines. The third terminal electrode to which the one end portion of the second winding is connected is connected to the other one of the pair of differential signal lines.

According to preferred embodiments of the present disclosure, there is also provided a direct-current superimposing circuit including a communication circuit that communicates with an external circuit via a pair of differential signal lines, the above-described winding-type coil component that is connected to the pair of the differential signal lines between the communication circuit and an external connection terminal that connects the pair of the differential signal lines to the external circuit, and a direct-current (DC) power supply that is connected between the first terminal electrode and the fourth terminal electrode in the winding-type coil component and superimposes a direct current on the pair of the differential signal lines. The communication circuit, the winding-type coil component, and the DC power supply are disposed at a circuit board.

With this configuration, the first winding and the second winding are wound around the winding core of the core. The one end portion and the other end portion of the first winding are connected to the terminal electrodes in one of the two pairs of terminal electrode which are placed to face each other across the winding core axis of the winding core on the end surface of the flange portion. The one end portion and the other end portion of the second winding are connected to the terminal electrodes in the other one of the two pairs of terminal electrode which are placed to face each other across the winding core axis of the winding core on the end surface of the flange portion. The numbers of turns of the first winding and the second winding wound around the winding core are the same. The difference between inductances formed by the first winding and the second winding is reduced. The degree of mode conversion in the winding-type coil component therefore decreases, a signal passing through the differential signal lines is unlikely to be converted from a differential-mode signal into common-mode noise, and unnecessary noise caused by the winding-type coil component is unlikely to be emitted.

Other features, elements, characteristics and advantages of the present disclosure will become more apparent from the following detailed description of preferred embodiments of the present disclosure with reference to the attached drawings.

DETAILED DESCRIPTION

Next, a winding-type coil component according to an embodiment of the present disclosure and a direct-current superimposing circuit using the winding-type coil component will be described.

Figure 3A:
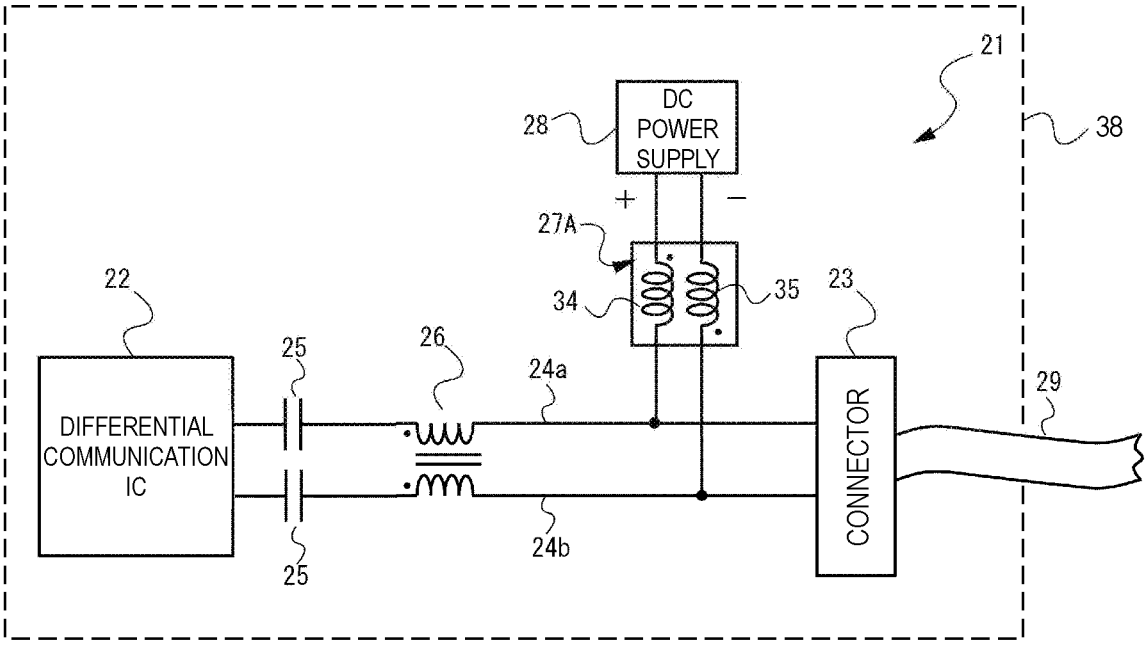
FIG. 3A is a block diagram illustrating the schematic configuration of a direct-current superimposing circuit according to a first embodiment of the present disclosure.

FIG. 3A is a block diagram illustrating the schematic configuration of a direct-current superimposing circuit 21 according to a first embodiment of the present disclosure using a winding-type coil component 27A according to the first embodiment.

Figure 9:
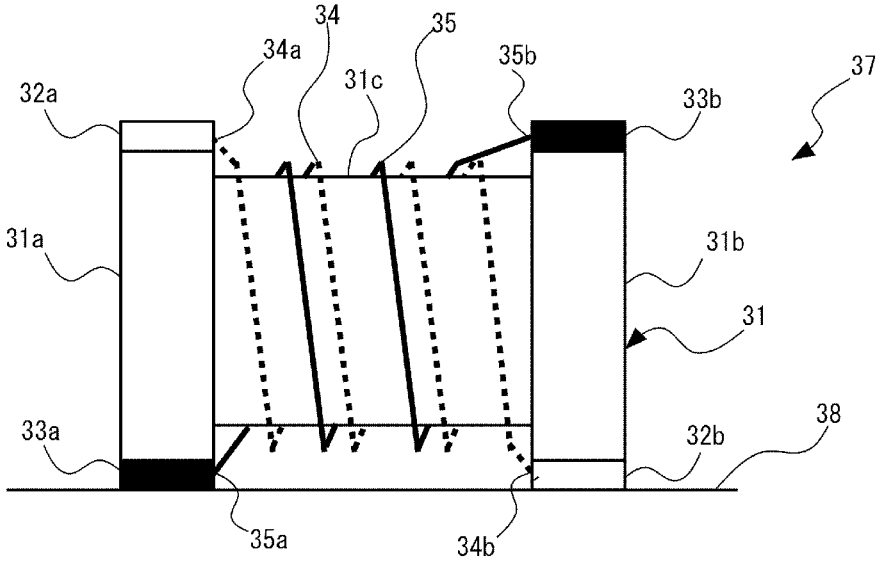
FIG. 9 is a side view of a horizontally wound winding-type coil component that is compared with a vertically wound winding-type coil component according to an embodiment of the present disclosure.

The direct-current superimposing circuit 21 is provided between a differential communication IC 22 that is a communication circuit for performing bidirectional communication including transmission and reception and a connector 23, includes a pair of differential signal lines 24*a* and 24*b*, two capacitors 25, a common mode choke coil 26, the winding-type coil component 27A, and a DC power supply 28, and is disposed on a circuit board (See also, e.g., mounting surface 38 of a circuit board as shown in FIG. 9 discussed below). The connector 23 is connected to an external circuit (not illustrated) including a communication IC that is the same as the differential communication IC 22 via a cable 29 and forms an external connection terminal for connecting a pair of the differential signal lines 24*a* and 24*b* to an external circuit. Between the differential communication IC 22 and an external circuit, bidirectional communication is performed via the differential signal lines 24*a* and 24*b* and the cable 29.

Through the pair of the differential signal lines 24*a* and 24*b*, a differential signal transmitted from the differential communication IC 22 and a differential signal to be received by the differential communication IC 22 pass. A direct current is superimposed on the differential signal lines 24*a* and 24*b* and the cable 29 by the DC power supply 28 and passes therethrough. The two capacitors 25 are provided at the respective differential signal lines 24*a* and 24*b* at the input/output ends of the differential communication IC 22 and prevent a direct current superimposed on the differential signal lines 24*a* and 24*b* from inputting into the differential communication IC 22. A common mode choke coil 26 is inserted into the differential signal lines 24*a* and 24*b* and attenuates common-mode noise passing through the differential signal lines 24*a* and 24*b*. Between the DC power supply 28 and the pair of the differential signal lines 24*a* and 24*b* on the side of an external circuit from the capacitors 25, the winding-type coil component 27A is connected to the pair of the differential signal lines 24*a* and 24*b* between the capacitors 25 and the connector 23. The winding-type coil component 27A prevents a differential signal passing through the differential signal lines 24*a* and 24*b* from leaking into the DC power supply 28.

Figure 4A:
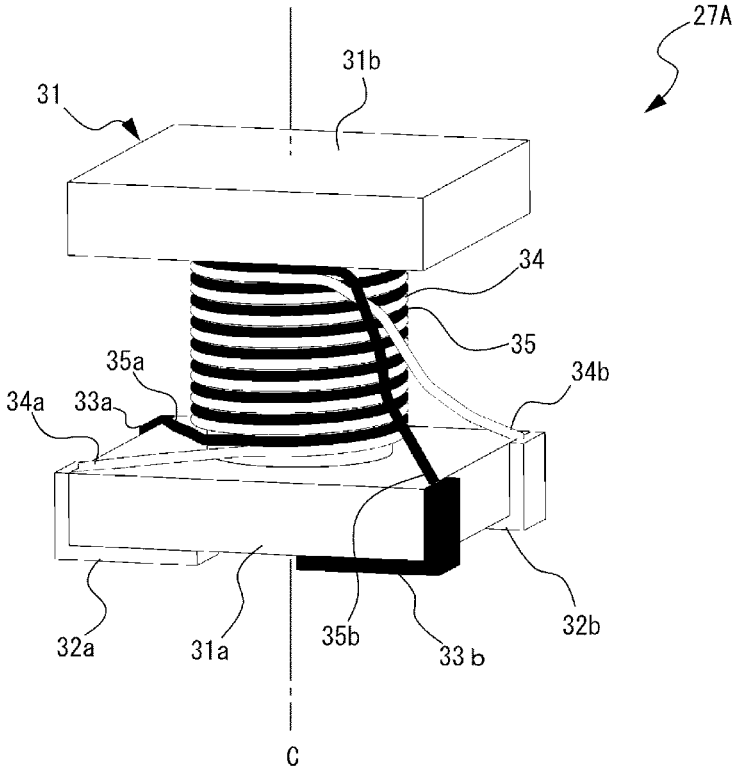
FIG. 4A is an external perspective view of a winding-type coil component according to the first embodiment used in the direct-current superimposing circuit illustrated in FIG. 3.
Figure 4B:
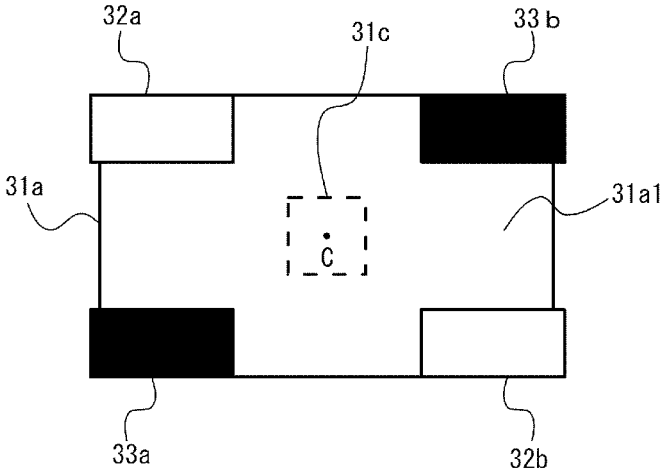
FIG. 4B is a bottom view of the winding-type coil component according to the first embodiment.

FIG. 4A is an external perspective view of the winding-type coil component 27A. FIG. 4B is a bottom view of the winding-type coil component 27A.

The winding-type coil component 27A includes a core 31, a pair of a first terminal electrode 32*a* and a second terminal electrode 32*b*, a pair of a third terminal electrode 33*a* and a fourth terminal electrode 33*b*, and two windings (a first winding 34 and a second winding 35). Like in the common mode choke coil 26, in the winding-type coil component 27A, the two windings 34 and 35 are wound to strengthen a magnetic flux that a signal current i flowing through the two windings 34 and 35 in the same direction generates at the core 31. However, the way of the connection of the winding-type coil component 27A to a circuit is different from the way of the connection of the common mode choke coil 26 to a circuit. The winding-type coil component 27A is used as a differential-mode inductor. That is, the winding-type coil component 27A is connected to a circuit such that the signal current i in the differential mode flows through the two windings 34 and 35 in opposite directions and impedance increases with respect to the signal current i in the differential mode.

The core 31 includes a pair of flange portions 31*a* and 31*b* and a winding core 31*c* made of an insulating material such as ferrite or alumina. The flange portion 31*a* placed below the flange portion 31*b* has an end surface 31*a*1 that is brought into contact with the mounting surface of a circuit board, such as mounting surface 38 of a circuit board as shown, for example, in FIG. 9 discussed below. The winding core 31*c* stands in a vertical direction with respect to the end surface 31*a*1. In the winding-type coil component 27A, the two windings 34 and 35 are vertically wound around the winding core 31*c*. The term of "being vertically wound" means that a winding core axis is perpendicular to the mounting surface of a coil component. On the end surface 31*a*1, the pair of the first terminal electrode 32*a* and the second terminal electrode 32*b* and the pair of the third terminal electrode 33*a* and the fourth terminal electrode 33*b* are placed to face each other at positions that are symmetric with respect to a winding center C of the winding core 31*c*. The winding center C coincides with the winding core axis of the winding core 31*c*. The term of "being placed to face each other at positions that are symmetric with respect to a point" means that the shortest line connecting the pair of the first terminal electrode 32*a* and the second terminal electrode 32*b* placed to face each other and the shortest line connecting the pair of the third terminal electrode 33*a* and the fourth terminal electrode 33*b* placed to face each other pass through the winding center C.

Each of the terminal electrodes 32*a*, 32*b*, 33*a*, and 33*b* has a two-layer structure including a base electrode made of, for example, Ag, an Cr—Cu alloy, or a Cr—Ni alloy and an external electrode made of, for example, Sn or an Sn—Pb alloy. An intermediate layer made of, for example, Ni or Cu may be inserted between the base electrode and the external electrode.

The windings 34 and 35 are formed of copper wires with the same diameter. On each of the surfaces of the windings 34 and 35, an insulating film made of polyurethane is provided. A winding start 34*a* and a winding end 34*b*, which are the end portions of the first winding 34 represented by a hollow line in the drawing, are connected to the first terminal electrode 32*a* and the second terminal electrode 32*b*, respectively, in one of the pairs of terminal electrodes. That is, the winding start 34*a* of the first winding 34 is connected to the first terminal electrode 32*a* and the winding end 34*b* of the first winding 34 is connected to the second terminal electrode 32*b*. The first winding 34 is connected between the first terminal electrode 32*a* and the second terminal electrode 32*b* in one of the pairs of terminal electrodes placed to face each other at positions that are symmetric with respect to the winding center C of the winding core 31*c*. The one end portion of the first winding 34 that is the winding start 34*a* and the other end portion of the first winding 34 that is the winding end 34*b* are located at positions that are symmetric with respect to the winding center C of the winding core 31*c*.

A winding start 35*a* and a winding end 35*b*, which are the end portions of the second winding 35 represented by a black line in the drawing, are connected to the third terminal electrode 33*a* and the fourth terminal electrode 33*b*, respectively, in the other one of the pairs of terminal electrodes. That is, the winding start 35*a* of the second winding 35 is connected to the third terminal electrode 33*a* and the winding end 35*b* of the second winding 35 is connected to the fourth terminal electrode 33*b*. The second winding 35 is connected between the third terminal electrode 33*a* and the fourth terminal electrode 33*b* in the other one of the pairs of terminal electrodes placed to face each other at positions that are symmetric with respect to the winding center C of the winding core 31*c*. The one end portion of the second winding 35 that is the winding start 35*a* and the other end portion of the second winding 35 that is the winding end 35*b* are located at positions that are symmetric with respect to the winding center C of the winding core 31*c*. The connection between the first winding 34 and each of the terminal electrodes 32*a* and 32*b* and the connection between the second winding 35 and each of the terminal electrodes 33*a* and 33*b* are performed by, for example, thermocompression bonding.

Although the winding start 34*a* and the winding end 34*b*, which are one end portion and the other end portion of the first winding 34, respectively, are connected to the first terminal electrode 32*a* and the second terminal electrode 32*b*, respectively and the winding start 35*a* and the winding end 35*b*, which are one end portion and the other end portion of the second winding 35, respectively, are connected to the third terminal electrode 33*a* and the fourth terminal electrode 33*b*, respectively as above, the relationship between the winding start and winding end of the first winding 34 and the relationship between the winding start and winding end of the second winding 35 may be opposite to those described above. That is, the other end portion of the first winding 34 that is the winding end 34*b* may be a winding start and connected to the second terminal electrode 32*b*, the one end portion of the first winding 34 that is the winding start 34*a* may be a winding end and connected to the first terminal electrode 32*a*, the other end portion of the second winding 35 that is the winding end 35*b* may be a winding start and connected to the fourth terminal electrode 33*b*, and one end portion of the second winding 35 that is the winding start 35*a* may be a winding end and connected to the third terminal electrode 33*a*.

Figure 3B:
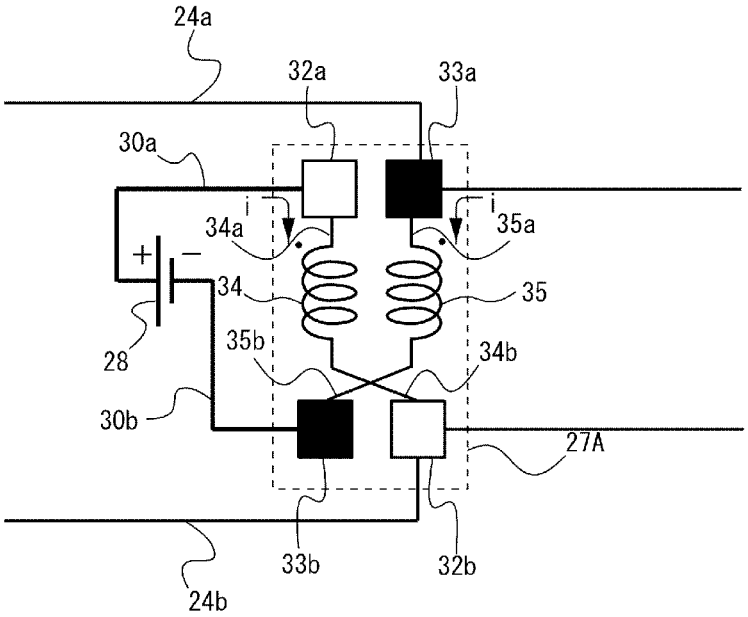
FIG. 3B is a diagram illustrating the state of connection of a winding-type coil component according to the first embodiment used in the direct-current superimposing circuit with differential signal lines.

In the first embodiment, as illustrated in FIG. 4A, the first winding 34 and the second winding 35 are wound around the winding core 31*c* while being parallel to each other and being brought into contact with each other. Specifically, the insulating films of the first winding 34 and the second winding 35 are brought into contact with each other. As illustrated in FIG. 3B, the second terminal electrode 32*b* to which the other end portion of the first winding 34 is connected is connected to the differential signal line 24*b* that is one of the pair of the differential signal lines 24*a* and 24*b*. The third terminal electrode 33*a* to which one end portion of the second winding 35 is connected is connected to the differential signal line 24*a* that is the other one of the pair of the differential signal lines 24*a* and 24*b*. The DC power supply 28 is connected between the first terminal electrode 32*a* and the fourth terminal electrode 33*b* and superimposes a direct current on the pair of the differential signal lines 24*a* and 24*b*.

In the winding-type coil component 27A according to the first embodiment, the first winding 34 and the second winding 35 are wound around the winding core 31*c* of the core 31 in a pair. The winding start 34*a* and the winding end 34*b* of the first winding 34 and the winding start 35*a* and the winding end 35*b* of the second winding 35 are connected to the two pairs of terminal electrodes, the terminal electrodes 32*a* and 32*b* and the terminal electrodes 33*a* and 33*b*, respectively, symmetrically placed with respect to the winding center C of the winding core 31*c* on a straight line passing through the winding center C on the end surface 31*a*1 of the flange portion 31*a*. That is, the winding start 34*a* and the winding end 34*b* of the first winding 34 are placed to face each other across the winding center C of the winding core 31*c* on the end surface 31*a*1 of the flange portion 31*a* and are connected to the first terminal electrode 32*a* and the second terminal electrode 32*b*, respectively in one of the pairs of terminal electrodes placed on a straight line passing through the winding center C. The winding start 35*a* and the winding end 35*b* of the second winding 35 are placed to face each other across the winding center C of the winding core 31*c* on the end surface 31*a*1 of the flange portion 31*a* and are connected to the third terminal electrode 33*a* and the fourth terminal electrode 33*b*, respectively in the other one of the pairs of terminal electrodes placed on a straight line passing through the winding center C.

Since the numbers of turns of the first winding 34 and the second winding 35 wound around the winding core 31*c* are the same, the difference between inductances formed by the first winding 34 and the second winding 35 becomes small. The degree of mode conversion in the winding-type coil component 27A is therefore suppressed, a differential signal passing through the differential signal lines 24*a* and 24*b* is unlikely to be converted into common-mode noise, and unnecessary noise caused by the winding-type coil component 27A is unlikely to be emitted.

In the direct-current superimposing circuit 21 according to the first embodiment, as illustrated in FIG. 4B, the first terminal electrode 32*a* to which the winding start 34*a* of the first winding 34, which is one of the two windings 34 and 35, is connected and the fourth terminal electrode 33*b* to which the winding end 35*b* of the second winding 35, which is the other one of the two windings 34 and 35, is connected are adjacent to each other in the circumferential direction of the flange portion 31*a* on the end surface 31*a*1 of the flange portion 31*a*. The third terminal electrode 33*a* to which the winding start 35*a* of the second winding 35, which is the other one of the two windings 34 and 35, is connected and the second terminal electrode 32*b* to which the winding end 34*b* of the first winding 34, which is one of the two windings 34 and 35, is connected are adjacent to each other in the circumferential direction of the flange portion 31*a* on the end surface 31*a*1 of the flange portion 31*a*.

Accordingly, even if the winding-type coil component 27A is used in the direct-current superimposing circuit 21 and the respective wiring patterns of a signal line and a power line and components are placed on a single plane of a circuit board, the wiring pattern of a power line 30*a* on the positive (+) side of the DC power supply 28 and the wiring pattern of a power line 30*b* on the negative (−) side of the DC power supply 28 can be connected to the winding start 34*a* of the first winding 34 that is one of the windings and the winding end 35*b* of the second winding 35 that is the other one of them, respectively without intersecting with the respective wiring patterns of the pair of the differential signal lines 24*a* and 24*b* as illustrated in FIG. 3B. The wiring patterns of the pair of the differential signal lines 24*a* and 24*b* can be connected to the winding start 35*a* of the second winding 35 that is the other one of the windings and the winding end 34*b* of the first winding 34 that is one of them, respectively without intersecting with the respective wiring patterns of the power lines 30*a* and 30*b*. Accordingly, the direct-current superimposing circuit 21 can be formed by routing the respective wiring pattern without forming a through-hole or the like in a circuit board unlike in the related art. The routing of the wiring patterns in the direct-current superimposing circuit 21 at a circuit board is simplified. In addition, the symmetries of the wiring line lengths and impedances of the differential signal lines 24*a* and 24*b* and the power lines 30*a* and 30*b* are kept, so that signal quality is maintained. As a result, according to the first embodiment, there can be provided the winding-type coil component 27A capable of suppressing the degradation in signal quality and the direct-current superimposing circuit 21 using the winding-type coil component 27A.

As illustrated in FIG. 4A, the first winding 34 and the second winding 35 are wound around the winding core 31*c* while being parallel to each other and being brought into contact with each other. However, the above-described operational effect can also obtained in a direct-current superimposing circuit using a winding-type coil component in which windings are separately wound around the winding core 31*c* in a pair. The term of "being separately wound" means that the windings are spaced from each other by the distance of about the diameters of two windings.

In the winding-type coil component 27A according to the first embodiment in which the first winding 34 and the second winding 35 are wound around the winding core 31*c* while being parallel to each other and being brought into contact with each other, the first winding 34 and the second winding 35 wound around the winding core 31*c* of the core 31 have the same diameter and the cross-sectional areas of the windings 34 and 35 are equal. In addition, the distance between the two windings 34 and 35 is reduced and the total amount of crossing of a magnetic flux generated at one of the windings 34 and 35 over the other one of them increases. This leads to the reduction in a leakage inductance. Since the amount of share of magnetic fluxes between the two windings 34 and 35 corresponds to the degree of magnetic coupling, the degree of magnetic coupling between the windings 34 and 35 increases and the respective windings 34 and 35 are magnetically coupled in a winding direction with the same degree of coupling in the winding-type coil component 27A. Accordingly, the symmetry of inductances formed by the respective windings 34 and 35 is enhanced, there is almost no difference between inductances formed by the respective windings 34 and 35, the degree of mode conversion of the winding-type coil component 27A is further reduced, and unnecessary noise caused by the winding-type coil component 27A is highly unlikely to be emitted.

Figure 5A:
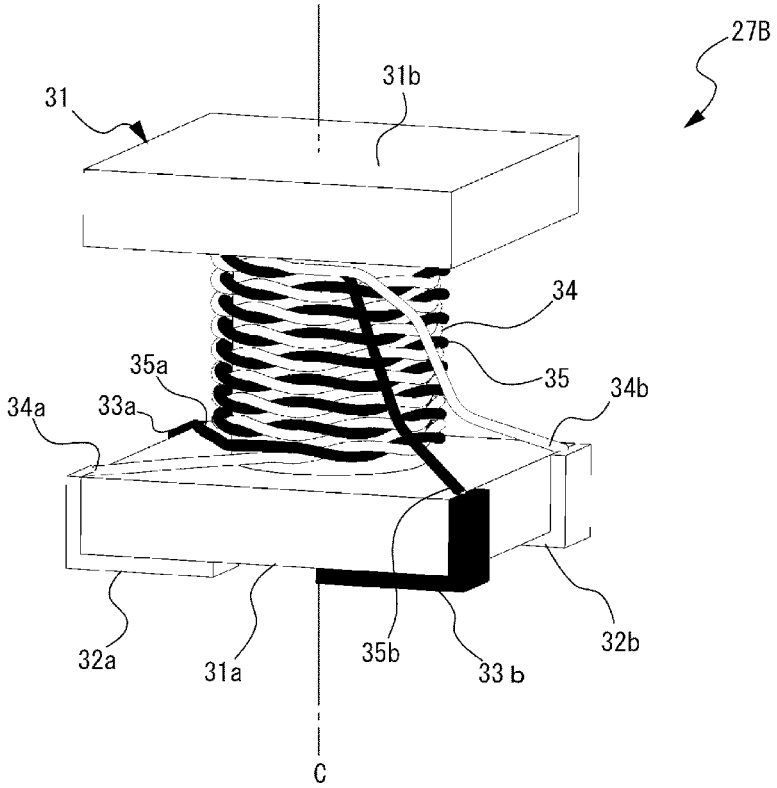
FIG. 5A is an external perspective view of a winding-type coil component according to a second embodiment of the present disclosure.
Figure 5B:
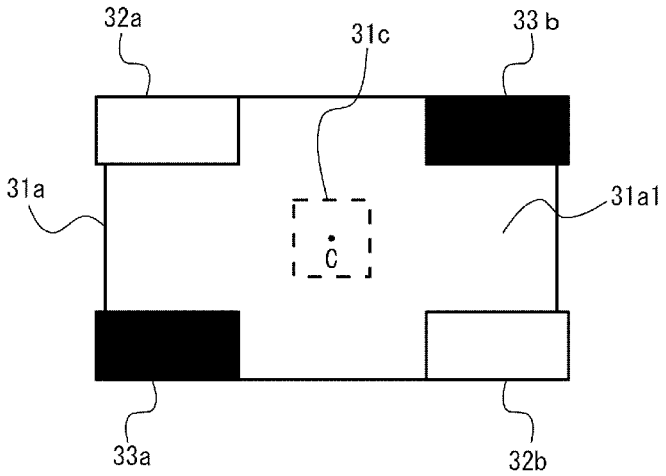
FIG. 5B is a bottom view of the winding-type coil component according to the second embodiment.

FIG. 5A is an external perspective view of a winding-type coil component 27B according to a second embodiment of the present disclosure used in a direct-current superimposing circuit according to the second embodiment. FIG. 5B is a bottom view of the winding-type coil component 27B. In FIGS. 5A and 5B, the same reference numerals are used to identify parts already described with reference to FIGS. 4A and 4B or equivalent parts, and the description thereof will be omitted.

A direct-current superimposing circuit according to the second embodiment differs from the direct-current superimposing circuit 21 according to the first embodiment only in that a winding-type coil component 27B illustrated in FIG. 5 is used instead of the winding-type coil component 27A in the direct-current superimposing circuit 21 according to the first embodiment.

In the winding-type coil component 27A, the first winding 34 and the second winding 35 are wound around the winding core 31*c* while being parallel to each other and being brought into contact with each other as illustrated in FIG. 4A. In the winding-type coil component 27B, the two windings, the first winding 34 and the second winding 35, are twisted and wound around the winding core 31*c* as illustrated in FIG. 5A.

In a direct-current superimposing circuit according to the second embodiment using the winding-type coil component 27B according to the second embodiment, like in the direct-current superimposing circuit 21 according to the first embodiment, the first winding 34 and the second winding 35 wound around the winding core 31*c* of the core 31 have the same diameter, the cross-sectional areas of the windings 34 and 35 are equal, the degree of magnetic coupling between the windings 34 and 35 increases, and the respective windings 34 and 35 are magnetically coupled in a winding direction with the same degree of coupling. In the second embodiment, since the windings 34 and 35 are twisted, the positional relationship between the windings 34 and 35 in a winding radial direction is alternately changed and a point where a winding diameter distance is small and a point where the winding diameter distance is large are mixed. As a result, a stray capacitance does not locally increase at each of the windings 34 and 35 and is made uniform and the distribution of a stray capacitance generated at each of the windings 34 and 35 becomes uniform. The degree of mode conversion in the winding-type coil component 27B is further reduced and unnecessary noise caused by the winding-type coil component 27B is more highly unlikely to occur as compared with the case where the windings 34 and 35 are wound around the winding core 31*c* while being parallel to each other and being brought into contact with each other in the first embodiment. Also in a direct-current superimposing circuit according to the second embodiment, the routing of the wiring patterns at a circuit board is simplified like in the direct-current superimposing circuit 21 according to the first embodiment.

Figure 6:
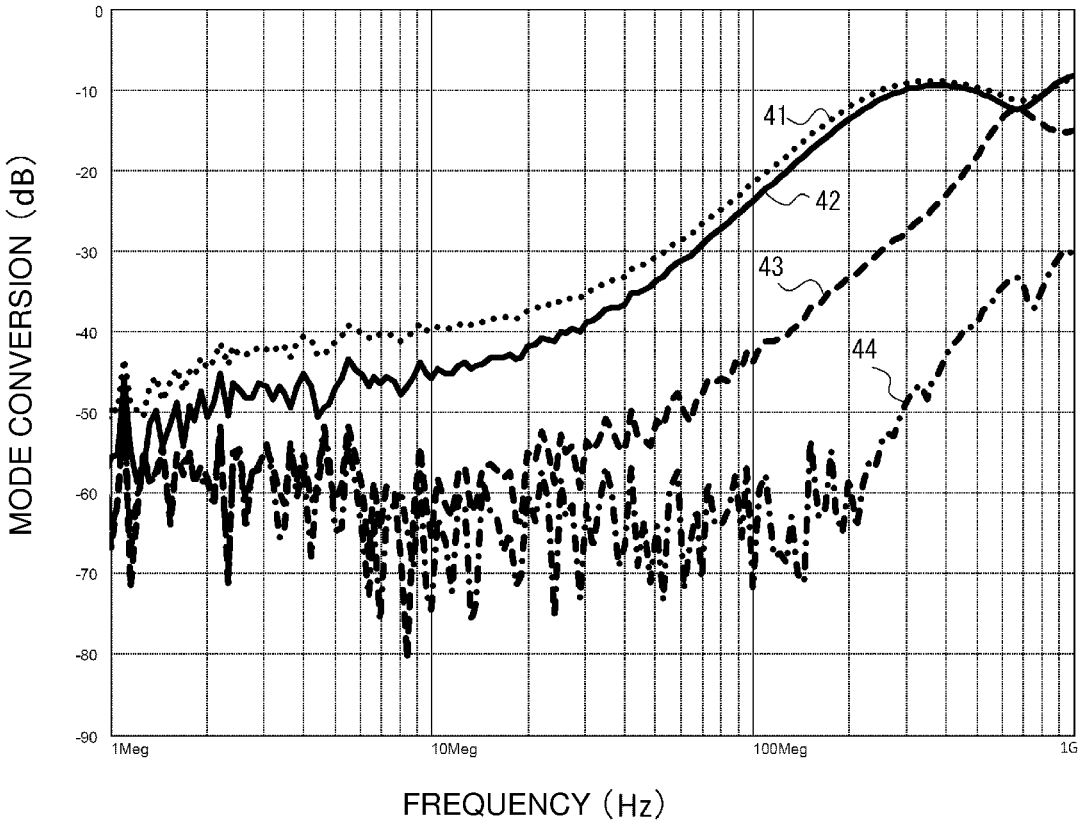
FIG. 6 is a graph representing actual measurement results of mode conversion characteristics of samples of winding-type coil components having different configurations used in a direct-current superimposing circuit that is a comparative example and a direct-current superimposing circuit according to an embodiment of the present disclosure.

FIG. 6 is a graph representing actual measurement results of mode conversion characteristics of samples of winding-type coil components having different configurations used in direct-current superimposing circuits. Referring to the graph, the horizontal axis represents frequency [Hz] and the vertical axis represents the magnitude [dB] of a mode-converted signal. This signal is a common-mode signal to which a differential signal from the differential signal lines 24*a* and 24*b* is mode-converted by a winding-type coil component, leaks, and is then reflected, so that this signal is measured at the differential signal lines 24*a* and 24*b*. Accordingly, it is desirable that the negative value of the magnitude of a mode-converted signal be as large as possible.

Figure 1:
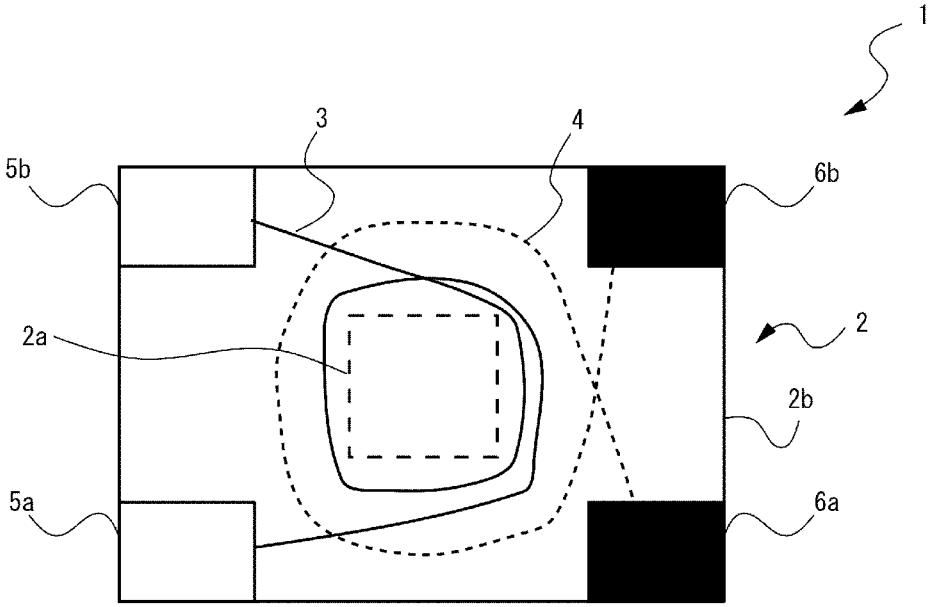
FIG. 1 is a bottom view of a winding-type coil component used in a direct-current superimposing circuit that is a comparative example.
Figure 2:
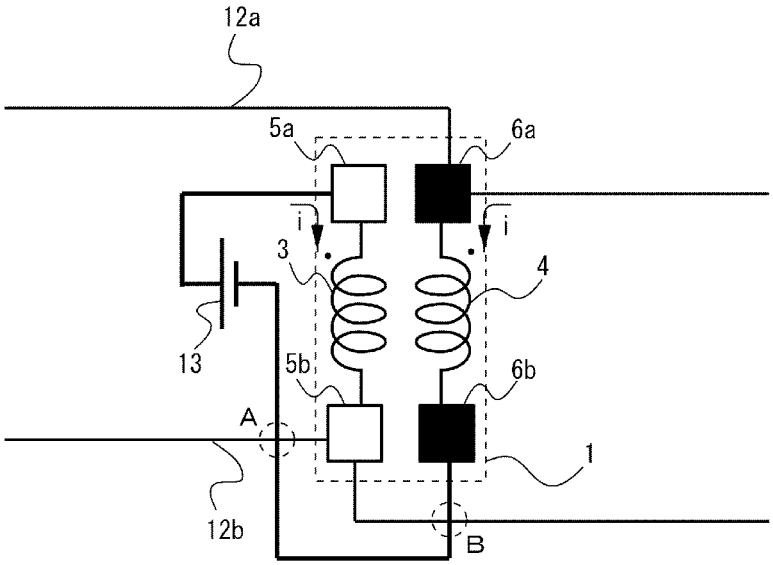
FIG. 2 is a diagram illustrating the state of connection of the winding-type coil component illustrated in FIG. 1 with differential signal lines.

A characteristic line 41 represented by a dotted line in this graph represents the mode conversion characteristics of a winding-type coil component in a direct-current superimposing circuit that is a comparative example. In this winding-type coil component, the number of turns of the first winding 3, which is one of the pair of the windings 3 and 4 illustrated in FIG. 1, is larger than that of the other one of them by 0.5 and the windings 3 and 4 between which there is a distance of diameters of two windings are separately wound around a winding core in a pair. A characteristic line 42 represented by a solid line represents the mode conversion characteristics of a winding-type coil component in a direct-current superimposing circuit that is a comparative example. In this winding-type coil component, the two windings 34 and 35 in the winding-type coil component 27A illustrated in FIG. 3 are not wound around the winding core 31*c* while being parallel with each other and being brought into contact with each other unlike in the first embodiment and the windings 34 and 35 between which there is a distance of diameters of two windings are separately wound around the winding core 31*c* in a pair. The respective direct-current superimposing circuits having the mode conversion characteristics represented by the characteristic lines 41 and 42 have the same configuration as the direct-current superimposing circuit 21 illustrated in FIG. 3A except for the winding-type coil component.

A characteristic line 43 represented by a broken line in this graph represents the mode conversion characteristics of the winding-type coil component 27A in the direct-current superimposing circuit 21 according to the first embodiment illustrated in FIG. 4. A characteristic line 44 represented by a dash-dotted line represents the mode conversion characteristics of the winding-type coil component 27B in a direct-current superimposing circuit according to the second embodiment illustrated in FIG. 5.

The graph indicates that, as represented by the characteristic line 42 of a circuit that is a comparative example using a winding-type coil component in which windings are separately wound around the winding core 31*c* in a pair, the level of a mode-converted signal is up to approximately 10 [dB] lower than that represented by the characteristic line 41 of a direct-current superimposing circuit that is a comparative example using a winding-type coil component in which the number of turns of one winding is larger than that of the other winding by 0.5 and unnecessary noise is unlikely to be emitted. The graph also indicates that, as represented by the characteristic line 43 of the direct-current superimposing circuit 21 according to the first embodiment using the winding-type coil component 27A in which the two windings 34 and 35 are wound around the winding core 31*c* while being parallel to each other and being brought into contact with each other, the level of a mode-converted signal is up to approximately 20 [dB] lower than that represented by the characteristic line 42 of a circuit that is a comparative example and unnecessary noise is highly unlikely to be emitted. The graph also indicates that, as represented by the characteristic line 44 of a direct-current superimposing circuit according to the second embodiment using the winding-type coil component 27B in which the two windings 34 and 35 are twisted and wound around the winding core 31*c*, the level of a mode-converted signal is up to approximately 20 [dB] lower than that represented by the characteristic line 43 of a circuit according to the first embodiment and unnecessary noise is more highly unlikely to be emitted as compared with a circuit according to the first embodiment.

Figure 7A:
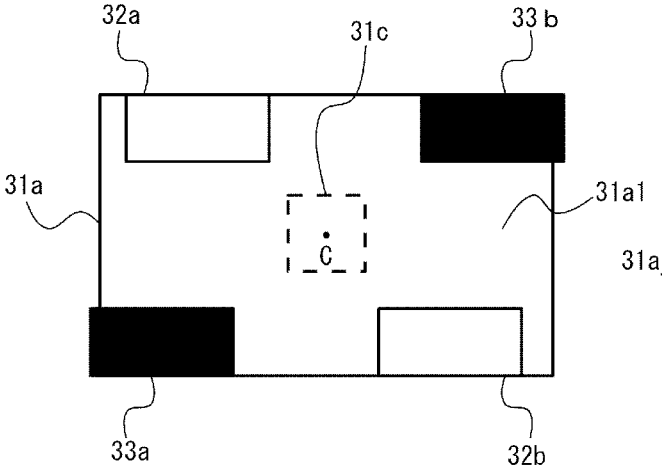
FIGS. 7A and 7B are bottom views of modifications of a winding-type coil component according to an embodiment.
Figure 7B:
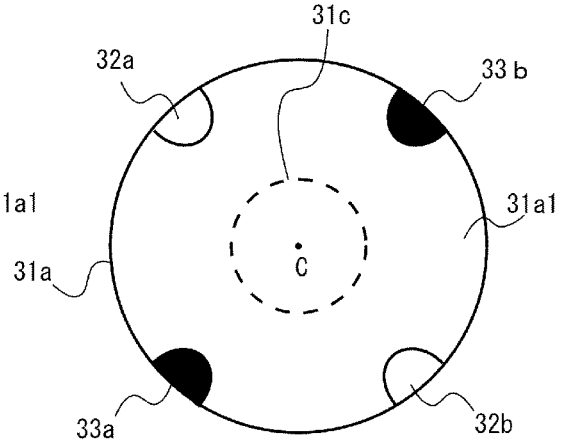

In the above embodiments, the description has been made of the case where the terminal electrodes 32*a* and 32*b* in one of the two pairs of terminal electrodes and the terminal electrodes 33*a* and 33*b* in the other one of them face each other at opposite corners of the end surface 31*a*1 of the flange portion 31*a* which are symmetric with respect to the winding center C of the winding core 31*c* as illustrated in FIGS. 4B and 5B. However, as illustrated in the bottom view in FIG. 7A, the terminal electrodes 32*a* and 32*b* in one of the two pairs of the terminal electrodes 32*a*, 32*b*, 33*a*, and 33*b* may face each other at positions that are away from the opposite corners of the end surface 31*a*1 of the flange portion 31*a* and are symmetric with respect to the winding center C of the winding core 31*c*. The flange portions 31*a* and 31*b* and the winding core 31*c* do not necessarily have to be substantially rectangular in shape and may be substantially circular in shape as illustrated in the bottom view in FIG. 7B on condition that the terminal electrodes 32*a* and 32*b* and the terminal electrodes 33*a* and 33*b*, which are two pairs of terminal electrodes, face each other across the winding center C of the winding core 31*c*. In FIGS. 7A and 7B, the same reference numerals are used to identify parts already described with reference to FIGS. 4B and 5B or equivalent parts, and the description thereof will be omitted.

Figure 8A:
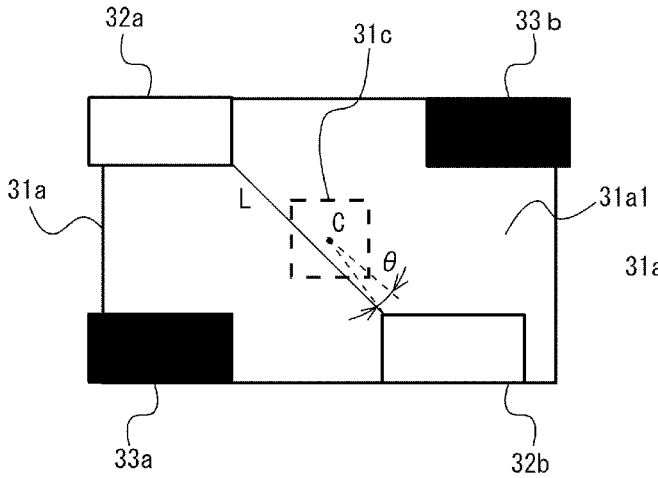
FIGS. 8A and 8B are bottom views of other modifications of a winding-type coil component according to an embodiment.
Figure 8B:
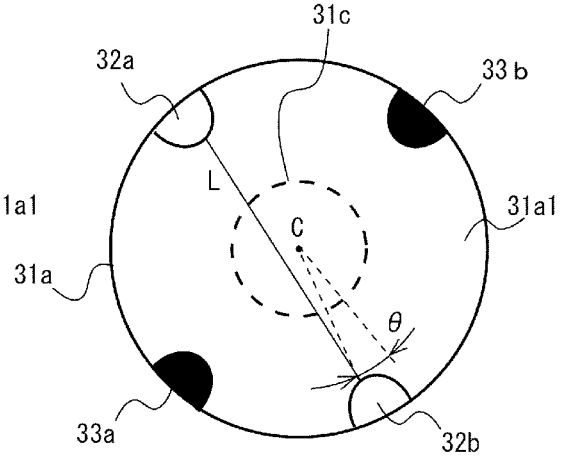

The terminal electrodes 32*a* and 32*b* and the terminal electrodes 33*a* and 33*b*, which are two pairs of terminal electrodes, do not necessarily have to be placed to face each other at positions that are perfectly symmetric with respect to the winding center C of the winding core 31*c* as illustrated in FIGS. 4B, 5B, 7A, and 7B. For example, as illustrated in FIGS. 8A and 8B, the shortest line L connecting the first terminal electrode 32*a* and the second terminal electrode 32*b* placed to face each other may not pass through the winding center C and be shifted within a range of the rotation angle of approximately 45° with respect to the winding center C. In FIGS. 8A and 8B, the same reference numerals are used to identify parts already described with reference to FIGS. 7A and 7B or equivalent parts, and the description thereof will be omitted. The winding start 34*a* and the winding end 34*b* of the first winding 34 and the winding start 35*a* and the winding end 35*b* of the second winding 35 similarly do not necessarily have to be placed to face each other at positions that are perfectly symmetric with respect to the winding center C of the winding core 31*c*. Even in the case of such arrangement of electrodes and such a winding structure, an operational effect similar to that obtained in the above embodiments illustrated in FIGS. 4B and 5B and the modifications illustrated in FIGS. 7A and 7B can be obtained.

In the first embodiment, the description has been made of the case where the first winding 34 and the second winding 35 are wound around the winding core 31*c* while being parallel to each other and being brought into contact with each other throughout the lengths of their winding portions in the winding-type coil component 27A. However, these windings may be wound around the winding core 31*c* while being parallel to each other and being brought into contact with each other throughout the lengths of at least parts of their winding portions. For example, even in the case where the first winding 34 and the second winding 35 are wound around the winding core 31*c* while being parallel to each other and being brought into contact with each other throughout the lengths of halves or more of their winding portions, an operational effect similar to that obtained in the above-described first embodiment can be obtained.

In the above second embodiment, the description has been made of the case where the first winding 34 and the second winding 35 are twisted and wound around the winding core 31*c* throughout the lengths of their winding portions in the winding-type coil component 27B. However, these windings may be twisted and wound around the winding core 31*c* throughout the lengths of at least parts of their winding portions. For example, even in the case where the first winding 34 and the second winding 35 are twisted and wound around the winding core 31*c* throughout the lengths of halves or more of their winding portions, an operational effect similar to that obtained in the above-described second embodiment can be obtained.

In the above embodiments, the description has been made of the case where the difference between the inductances of the two windings 34 and 35 in the winding-type coil components 27A and 27B is reduced or almost eliminated. It is most desirable that the inductances of the first winding 34 and the second winding 35 be equal to each other. The term of "being equal to each other" means that the difference between the inductances is less than or equal to 1%. For example, in the case where the inductance value of the first winding 34 is 10.1 H, the inductance value of the second winding 35 is 9.9 H, the difference between the inductance values is 0.2 H, and the average value of the inductance values is 10.0 H, the percentage of the difference between the inductance values of 0.2 H to the average value of the inductance values of 10.0 H is 2% and the difference between the inductance values of 0.2 H is within the range of ±1% of the average value of the inductance values of 10.0 H. In this case, since the difference between the inductances is less than or equal to 1% defined above, it can be said that the inductances of the first winding 34 and the second winding 35 are equal to each other.

In the above embodiments and the above modifications, the description has been made of the winding-type coil components 27A and 27B in which the two windings 34 and 35 are vertically wound around the winding core 31*c*. The application of the present disclosure to a vertically wound winding-type coil component is suitable and the application of the present disclosure to, for example, a horizontally wound winding-type coil component 37 illustrated in FIG. 9 is not suitable.

In the horizontally wound winding-type coil component 37, the winding core axis of the winding core 31*c* of the core 31 around which the two windings 34 and 35 are wound is placed parallel to a component mounting surface 38. At the top end of the flange portion 31*a* on the left side, the first terminal electrode 32*a* is provided to which the winding start 34*a* of the first winding 34 represented by a dotted line is connected. At the bottom end of the flange portion 31*a*, the third terminal electrode 33*a* is provided to which the winding start 35*a* of the second winding 35 represented by a solid line is connected. At the top end of the flange portion 31*b* on the right side, the fourth terminal electrode 33*b* is provided to which the winding end 35*b* of the second winding 35 is connected. At the bottom end of the flange portion 31*b*, the second terminal electrode 32*b* is provided to which the winding end 34*b* of the first winding 34 is connected. The first winding 34 connects the first terminal electrode 32*a* and the second terminal electrode 32*b*. The second winding 35 connects the third terminal electrode 33*a* and the fourth terminal electrode 33*b*.

In the horizontally wound winding-type coil component 37, the number of turns of the first winding 34 represented by the dotted line wound around the winding core 31*c* of the core 31 is larger than that of the second winding 35 represented by the solid line by 0.5 like in the winding-type coil component 1 illustrated in FIG. 1. Accordingly, inductances formed by the two respective windings 34 and 35 become asymmetrical with each other and the degree of mode conversion in the winding-type coil component 37 becomes high. The application of the present disclosure to a horizontally wound winding-type coil component is therefore not suitable.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A winding-type coil component comprising:

a core including a pair of flange portions, only one of the flanges having an end surface configured for contact with a mounting surface of a circuit board and a winding core standing in a vertical direction with respect to the end surface of the one flange;

a pair of a first terminal electrode and a second terminal electrode that face each other through a winding core axis of the winding core on the end surface of the one flange;

a pair of a third terminal electrode and a fourth terminal electrode that face each other through the winding core axis of the winding core on the end surface of the one flange;

a first winding having one end portion, which is a winding start or a winding end, connected to the first terminal electrode and an other end portion, which is a winding start or a winding end, connected to the second terminal electrode; and a second winding having one end portion, which is a winding start or a winding end, connected to the third terminal electrode and an other end portion, which is a winding start or a winding end, connected to the fourth terminal electrode, the first winding and the second winding being wound around the winding core, wherein the second terminal electrode to which the other end portion of the first winding is connected is connected to one of a pair of differential signal lines, and wherein the third terminal electrode to which the one end portion of the second winding is connected is connected to an other one of the pair of differential signal lines.

2. The winding-type coil component according to claim 1, wherein the first winding and the second winding are wound around the winding core while being parallel to each other and being brought into contact with each other throughout lengths of at least parts of winding portions of the first winding and the second winding.

3. The winding-type coil component according to claim 1, wherein the first winding and the second winding are twisted and wound around the winding core throughout lengths of at least parts of winding portions of the first winding and the second winding.

4. The winding-type coil component according to claim 1, wherein an inductance of the first winding connected between the pair of the first terminal electrode and the second terminal electrode and an inductance of the second winding connected between the pair of the third terminal electrode and the fourth terminal electrode are equal.

5. The winding-type coil component according to claim 1, wherein the first terminal electrode and the second terminal electrode in the pair are symmetrically placed about the winding core axis of the winding core on the end surface, and the third terminal electrode and the fourth terminal electrode in the pair are symmetrically placed about the winding core axis of the winding core on the end surface.

6. The winding-type coil component according to claim 1, wherein the first terminal electrode and the second terminal electrode are placed at one of pairs of opposite corners of the end surface that is substantially rectangular in shape, and the third terminal electrode and the fourth terminal electrode are placed at an other one of the pairs of opposite corners of the end surface that is substantially rectangular in shape.

7. A direct-current superimposing circuit comprising:

a communication circuit that communicates with an external circuit via the pair of differential signal lines;

winding-type coil component according to claim 1 which is connected to the pair of the differential signal lines between the communication circuit and an external connection terminal that connects the pair of the differential signal lines to the external circuit; and a direct-current (DC) power supply that is connected between the first terminal electrode and the fourth terminal electrode in the winding-type coil component and superimposes a direct current on the pair of the differential signal lines, the communication circuit, the winding-type coil component, and the DC power supply being disposed at the circuit board.

8. The winding-type coil component according to claim 2, wherein an inductance of the first winding connected between the pair of the first terminal electrode and the second terminal electrode and an inductance of the second winding connected between the pair of the third terminal electrode and the fourth terminal electrode are equal.

9. The winding-type coil component according to claim 3, wherein an inductance of the first winding connected between the pair of the first terminal electrode and the second terminal electrode and an inductance of the second winding connected between the pair of the third terminal electrode and the fourth terminal electrode are equal.

10. The winding-type coil component according to claim 2, wherein the first terminal electrode and the second terminal electrode in the pair are symmetrically placed about the winding core axis of the winding core on the end surface, and the third terminal electrode and the fourth terminal electrode in the pair are symmetrically placed about the winding core axis of the winding core on the end surface.

11. The winding-type coil component according to claim 3, wherein the first terminal electrode and the second terminal electrode in the pair are symmetrically placed about the winding core axis of the winding core on the end surface, and the third terminal electrode and the fourth terminal electrode in the pair are symmetrically placed about the winding core axis of the winding core on the end surface.

12. The winding-type coil component according to claim 4, wherein the first terminal electrode and the second terminal electrode in the pair are symmetrically placed about the winding core axis of the winding core on the end surface, and the third terminal electrode and the fourth terminal electrode in the pair are symmetrically placed about the winding core axis of the winding core on the end surface.

13. The winding-type coil component according to claim 2, wherein the first terminal electrode and the second terminal electrode are placed at one of pairs of opposite corners of the end surface that is substantially rectangular in shape, and the third terminal electrode and the fourth terminal electrode are placed at an other one of the pairs of opposite corners of the end surface that is substantially rectangular in shape.

14. The winding-type coil component according to claim 3, wherein the first terminal electrode and the second terminal electrode are placed at one of pairs of opposite corners of the end surface that is substantially rectangular in shape, and the third terminal electrode and the fourth terminal electrode are placed at an other one of the pairs of opposite corners of the end surface that is substantially rectangular in shape.

15. The winding-type coil component according to claim 4, wherein the first terminal electrode and the second terminal electrode are placed at one of pairs of opposite corners of the end surface that is substantially rectangular in shape, and the third terminal electrode and the fourth terminal electrode are placed at an other one of the pairs of opposite corners of the end surface that is substantially rectangular in shape.

16. The winding-type coil component according to claim 5, wherein the first terminal electrode and the second terminal electrode are placed at one of pairs of opposite corners of the end surface that is substantially rectangular in shape, and the third terminal electrode and the fourth terminal electrode are placed at an other one of the pairs of opposite corners of the end surface that is substantially rectangular in shape.

17. A direct-current superimposing circuit comprising:

a communication circuit that communicates with an external circuit via the pair of differential signal lines;

the winding-type coil component according to claim 2 which is connected to the pair of the differential signal lines between the communication circuit and an external connection terminal that connects the pair of the differential signal lines to the external circuit; and a direct-current (DC) power supply that is connected between the first terminal electrode and the fourth terminal electrode in the winding-type coil component and superimposes a direct current on the pair of the differential signal lines, the communication circuit, the winding-type coil component, and the DC power supply being disposed at the circuit board.

18. A direct-current superimposing circuit comprising:

a communication circuit that communicates with an external circuit via the pair of differential signal lines;

the winding-type coil component according to claim 3 which is connected to the pair of the differential signal lines between the communication circuit and an external connection terminal that connects the pair of the differential signal lines to the external circuit; and a direct-current (DC) power supply that is connected between the first terminal electrode and the fourth terminal electrode in the winding-type coil component and superimposes a direct current on the pair of the differential signal lines, the communication circuit, the winding-type coil component, and the DC power supply being disposed at the circuit board.

19. A direct-current superimposing circuit comprising:

a communication circuit that communicates with an external circuit via the pair of differential signal lines;

the winding-type coil component according to claim 4 which is connected to the pair of the differential signal lines between the communication circuit and an external connection terminal that connects the pair of the differential signal lines to the external circuit; and a direct-current (DC) power supply that is connected between the first terminal electrode and the fourth terminal electrode in the winding-type coil component and superimposes a direct current on the pair of the differential signal lines, the communication circuit, the winding-type coil component, and the DC power supply being disposed at the circuit board.

20. A direct-current superimposing circuit comprising:

a communication circuit that communicates with an external circuit via the pair of differential signal lines;

the winding-type coil component according to claim 5 which is connected to the pair of the differential signal lines between the communication circuit and an external connection terminal that connects the pair of the differential signal lines to the external circuit; and a direct-current (DC) power supply that is connected between the first terminal electrode and the fourth terminal electrode in the winding-type coil component and superimposes a direct current on the pair of the differential signal lines, the communication circuit, the winding-type coil component, and the DC power supply being disposed at the circuit board.

* * * * *